US007757745B2

(12) United States Patent
Luczak

(10) Patent No.: US 7,757,745 B2
(45) Date of Patent: Jul. 20, 2010

(54) CONTOURED METALLIC CASTING CORE

(75) Inventor: Blake J. Luczak, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 958 days.

(21) Appl. No.: 11/433,500

(22) Filed: May 12, 2006

(65) Prior Publication Data

US 2007/0261814 A1 Nov. 15, 2007

(51) Int. Cl.
*B22C 9/00* (2006.01)

(52) U.S. Cl. ..... 164/28

(58) Field of Classification Search ..... 164/28, 164/369, 516

See application file for complete search history.

(56) References Cited

U.S. PATENT DOCUMENTS

| | | | | |
|---|---|---|---|---|
| 6,637,500 | B2 | 10/2003 | Shah et al. | |
| 6,929,054 | B2 | 8/2005 | Beals et al. | |
| 2004/0202542 | A1 * | 10/2004 | Cunha et al. | 416/97 R |
| 2006/0090871 | A1 * | 5/2006 | Snyder et al. | 164/45 |
| 2007/0227683 | A1 * | 10/2007 | Judge et al. | 164/28 |

* cited by examiner

*Primary Examiner*—Jessica L. Ward
*Assistant Examiner*—Steven Ha
(74) *Attorney, Agent, or Firm*—Bachman & LaPointe, P.C.

(57) ABSTRACT

A method for manufacturing an investment casting core uses a metallic blank having a thickness between parallel first and second faces less than a width and length transverse thereto. The blank is locally thinned from at least one of the first and second faces. The blank is through-cut across the thickness.

17 Claims, 10 Drawing Sheets

CONTOURED METALLIC CASTING CORE

BACKGROUND OF THE INVENTION

The invention relates to investment casting. More particularly, it relates to the investment casting of superalloy turbine engine components.

Investment casting is a commonly used technique for forming metallic components having complex geometries, especially hollow components, and is used in the fabrication of superalloy gas turbine engine components. The invention is described in respect to the production of particular superalloy castings, however it is understood that the invention is not so limited.

Gas turbine engines are widely used in aircraft propulsion, electric power generation, and ship propulsion. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

The cooling passageway sections may be cast over casting cores. Ceramic casting cores may be formed by molding a mixture of ceramic powder and binder material by injecting the mixture into hardened steel dies. After removal from the dies, the green cores are thermally post-processed to remove the binder and fired to sinter the ceramic powder together. The trend toward finer cooling features has taxed core manufacturing techniques. The fine features may be difficult to manufacture and/or, once manufactured, may prove fragile. Commonly-assigned U.S. Pat. No. 6,637,500 of Shah et al. and U.S. Pat. No. 6,929,054 of Beals et al (the disclosures of which are incorporated by reference herein as if set forth at length) disclose use of ceramic and refractory metal core combinations.

FIG. 1 shows a trailing edge portion of a turbine airfoil 20 as cast within a shell 22. For casting the internal passageways, the shell contains a core assembly. The exemplary core assembly includes a ceramic feed core having spanwise legs 30, 32, and 34 for casting associated passageway legs. The leg 34 casts a trailing spanwise passageway 36. The core assembly also includes metallic cores, of which cores 40, 42, and 44 are shown. The exemplary metallic cores are formed of refractory metal sheet stock. The core 40 forms a pressure side outlet circuit, the core 42 forms a suction side outlet circuit, and the core 44 forms a trailing edge outlet slot 50. The outlet slot 50 is fed from the passageway 36. During core assembly, a leading portion of the core 44 is secured within a mating slot of the trailing leg 34 of the ceramic core. With such a configuration, the transition between the passageway 36 and the outlet slot 50 may be relatively abrupt and may create relatively thick areas 52 and 54 of the pressure and suction side walls.

SUMMARY OF THE INVENTION

One aspect of the invention involves a method for manufacturing an investment casting core from a metallic blank.

The blank has a thickness between parallel first and second faces less than a length and width transverse thereto. The blank is locally thinned from at least one of the first and second faces. The blank is through-cut across the thickness.

In various implementations, through-cutting may comprise at least one of laser cutting, liquid jet cutting, and EDM. The thinning may comprise at least one of EDM, ECM, grinding, and mechanical machining. The through-cutting may comprise forming a plurality of through-apertures and a plurality of recesses. After the through-cutting, the blank may be bent to at least partially contract the recesses. The thinning may comprise machining a downstream-tapering portion and leaving a thicker portion downstream of the downstream-tapering portion. The core may be coated. The core may be overmolded with a ceramic core or assembled to a pre-molded ceramic core. The thinning may form a mounting flange by thinning from both the first and second faces. The mounting flange may be overmolded by a ceramic core or inserted into a mating slot of a pre-molded ceramic core.

In an investment casting method, the investment casting core may be at least partially overmolded by a pattern-forming material for forming a pattern. The pattern may be shelled. The pattern-forming material may be removed from the shelled pattern for forming a shell. Molten alloy may be introduced to the shell. The shell may be removed. The method may be used to form a gas turbine engine component. An exemplary component is an airfoil wherein the core forms trailing edge outlet passageways.

Another aspect of the invention involves an investment casting core having a metallic core element and a ceramic core. The metallic core element has a flange extending from a second portion, the second portion thicker than the flange. The ceramic casting core has a slot receiving the flange and slot shoulders abutting shoulders of the second portion. A smooth continuous taper may span a junction between the metallic casting core element and the ceramic casting core. The slot may be pre-molded or formed by overmolding the metallic casting core element.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 2:
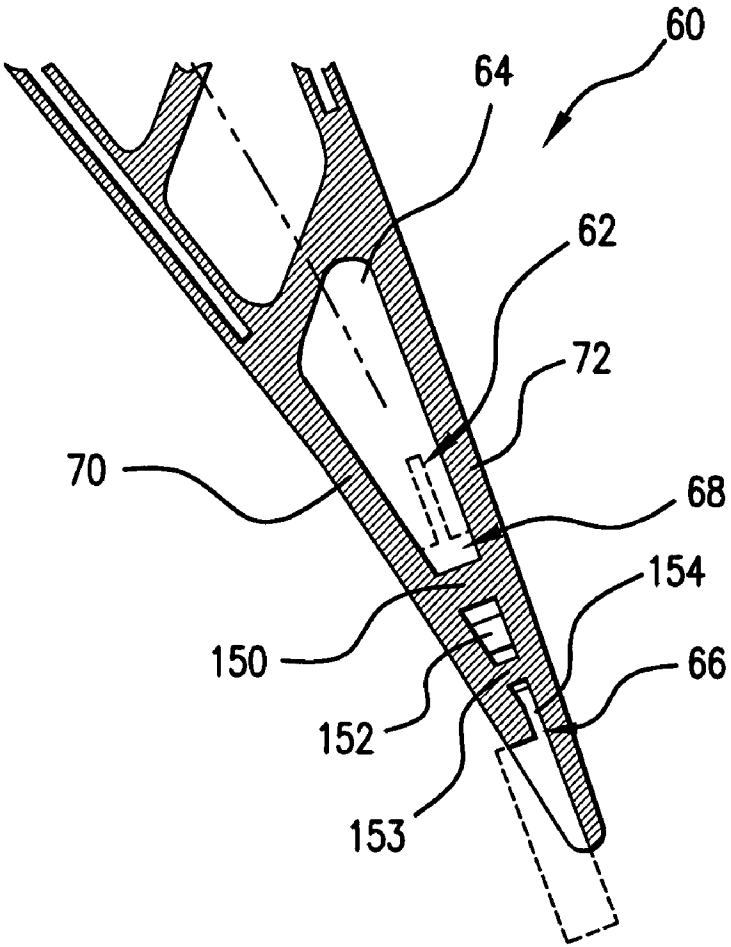
FIG. 2 is a partial streamwise sectional view of a modified airfoil.
Figure 1:
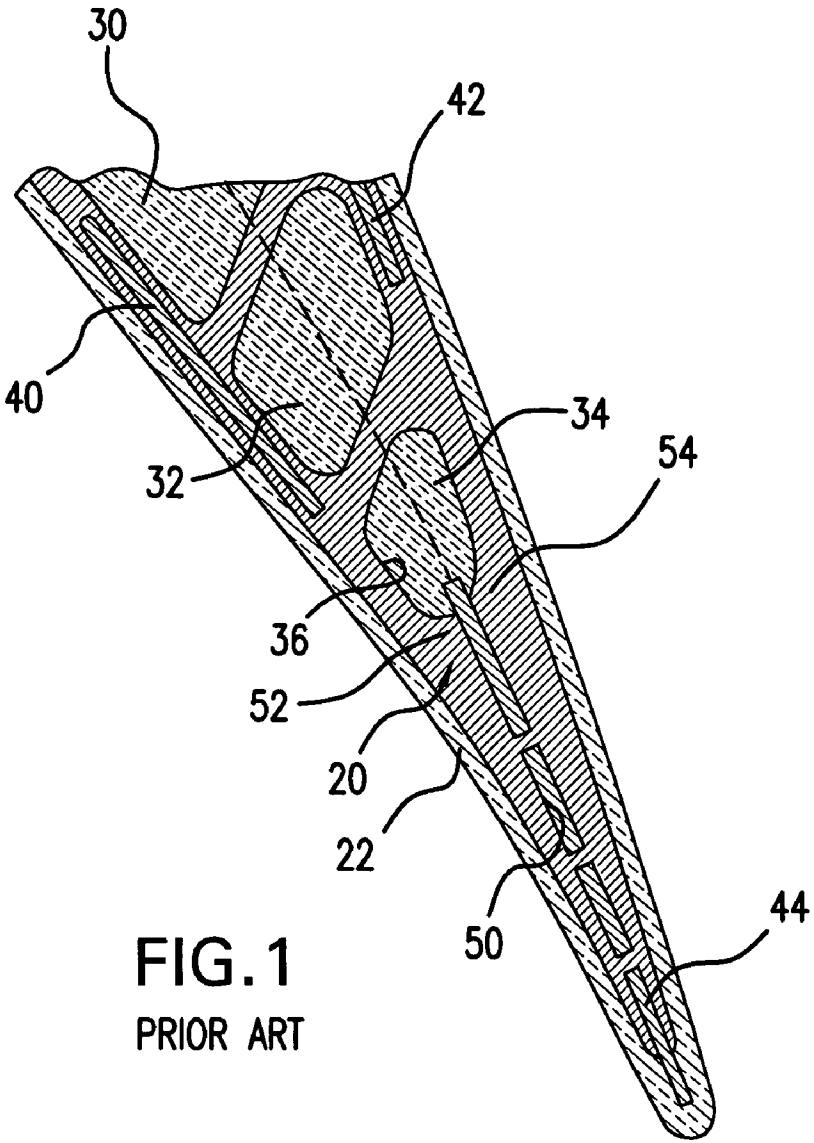
FIG. 1 PRIOR ART
FIG. 1 is a partial streamwise sectional view of a trailing edge portion of a prior art airfoil cast within a ceramic shell.

FIG. 2 shows a reengineered airfoil 60 which may be based upon the exemplary airfoil 20. The airfoil 60 has a relatively gently transitioning junction 62 between a trailing feed passageway/cavity 64 and an outlet slot 66. For example, a leading portion 68 of the slot 66 has a downstream-tapering thickness profile which tends to reduce the peak thickness of the pressure and suction side walls 70 and 72 (thereby reducing part mass, improving part cooling, and reducing resistance to the cooling airflow). Similar smooth transitions have been attempted with purely ceramic cores. However, such purely ceramic cores then suffer breakage problems if fine features of the outlet slot are to be cast.

Figure 3:
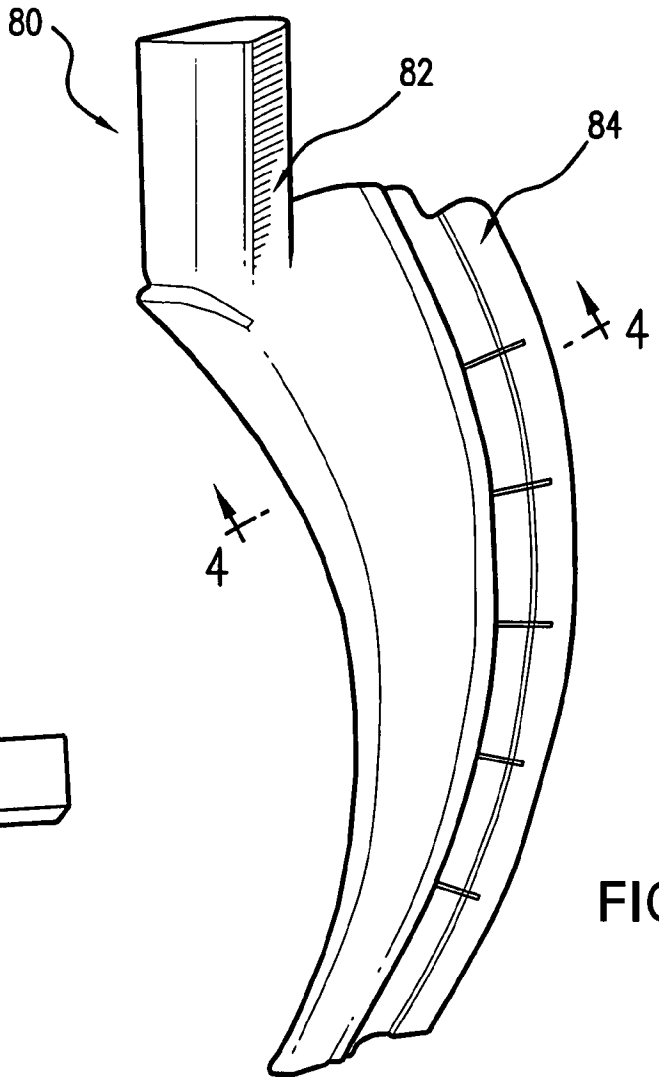
FIG. 3 is a view of a composite core for casting the airfoil of FIG. 2.

FIG. 3 shows a portion of a core assembly 80 for casting the passageways 64 and 66 of FIG. 2. The core 80 includes a ceramic core element/portion 82 and a refractory metal core (RMC) element/portion 84 (also shown in broken lines in FIG. 2). For purposes of illustration, remaining portions of the ceramic core element 82 are not shown. Additionally, apertures within both of the elements 82 and 84 are also not shown.

Figure 4:
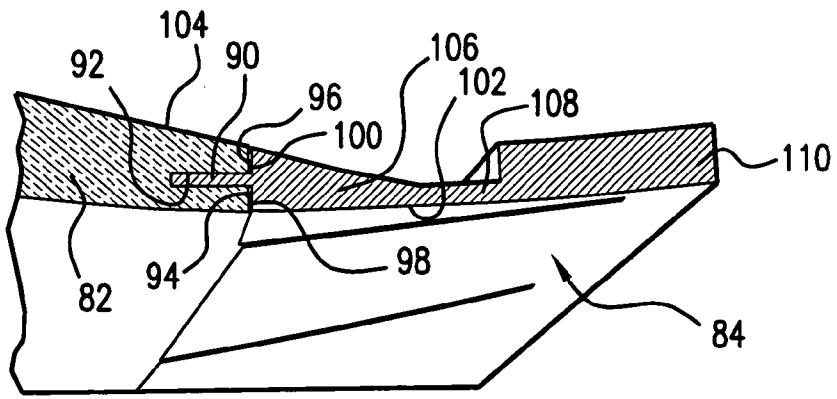
FIG. 4 is a streamwise sectional view of a trailing portion of the composite core of FIG. 3.
Figure 5:
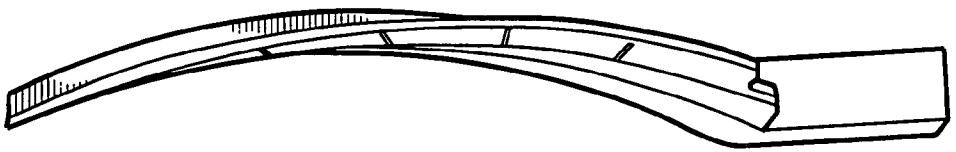
FIG. 5 is a trailing edge view of the composite core of FIG. 3.

FIG. 4 shows the RMC 84 as including a leading tenon 90 received within a trailing slot or mortise 92 of the ceramic core element 82. The exemplary tenon and slot are flat with parallel surfaces respectively facing pressure and suction sides of the airfoil. At a root of the tenon 90, the RMC 84 expands outward with a pair of shoulders 94 and 96 engaging trailing face portions 98 and 100 of the ceramic core element 82. These mating faces extend outward to respective suction and pressure side faces 102 and 104 of the core assembly 80. The side faces 102 and 104 smoothly transition between the ceramic core element 82 and the RMC 84. This junction between RMC and ceramic core falls along a tapering portion 106. Downstream of tapering portion 106, the RMC transitions to a straight flat portion 108 and then to a thicker portion 110 wherein the pressure side face 104 protrudes. The exemplary suction side face 102 is smooth along the tapering portion, flat portion, and thicker portion 110.

Figure 6:
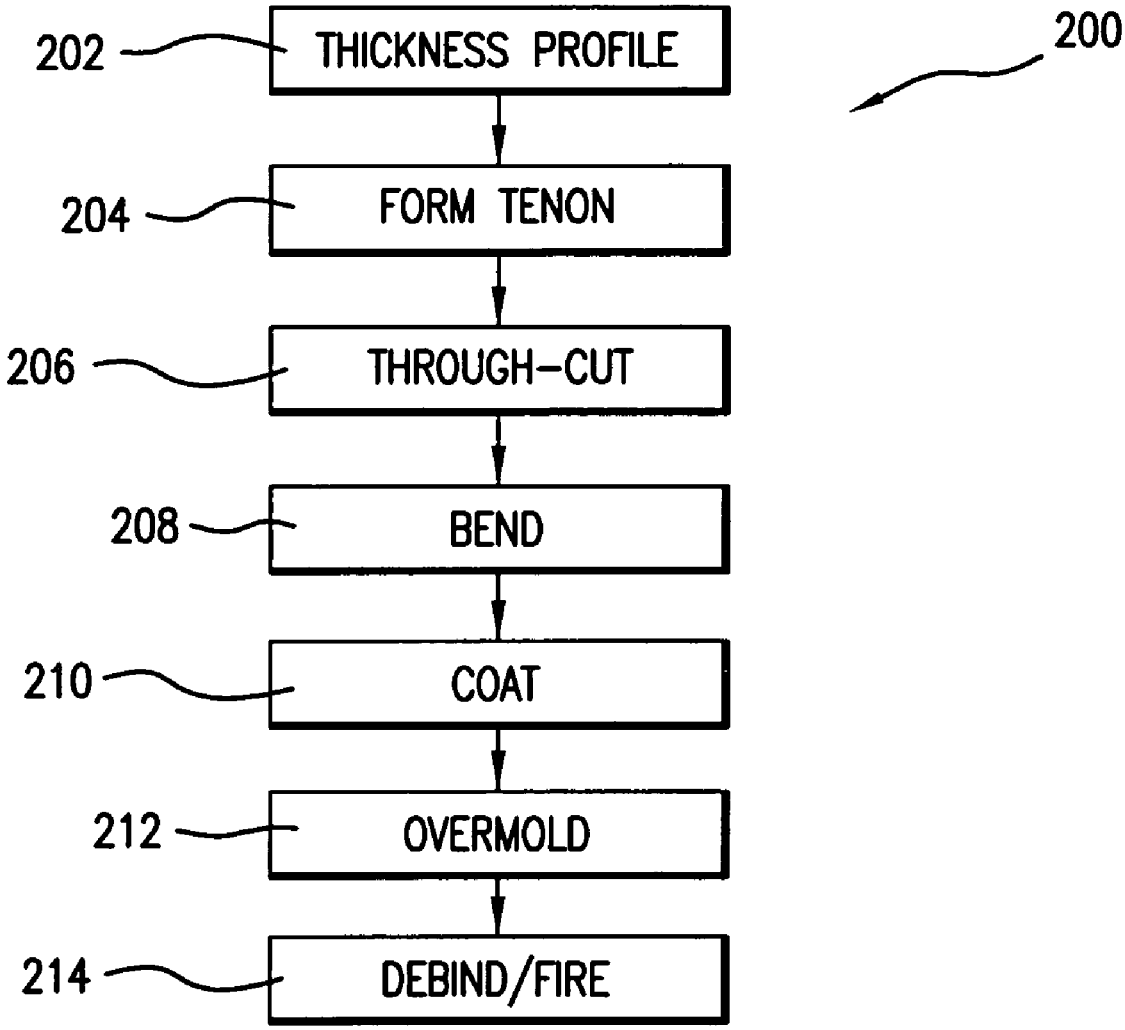
FIG. 6 is a flowchart of a core manufacture process.
Figure 7:
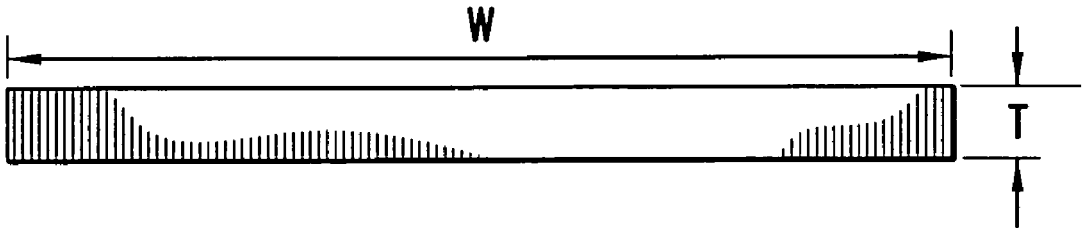
FIG. 7 is an end view of a core precursor.
Figure 8:
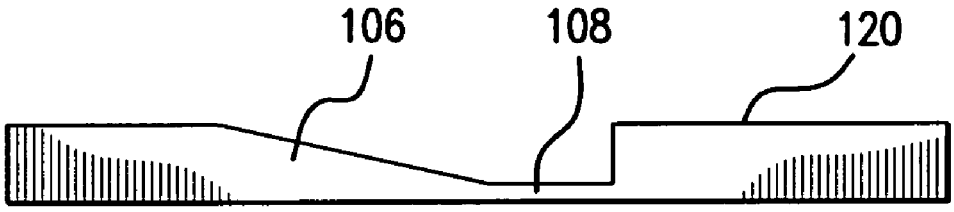
FIG. 8 is an end view of the precursor of FIG. 7 after a first local thinning from a first face.
Figure 9:
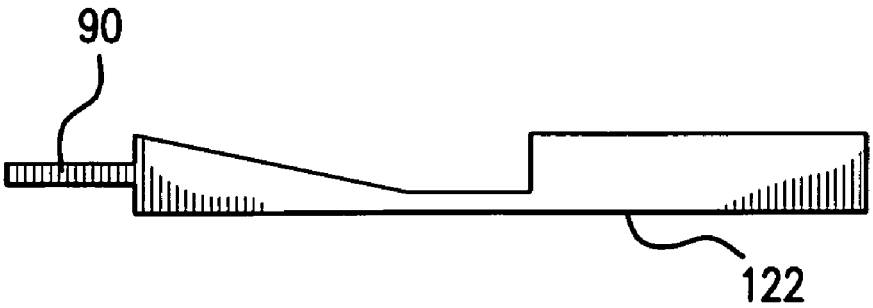
FIG. 9 is an end view of the precursor of FIG. 8 after additional thinning from the first face and an opposite second face to form a mounting flange.

In an exemplary sequence 200 of manufacture (FIG. 6) The RMC 84 may be machined from a strip (FIG. 7) having a thickness T, a greater width W, and a yet greater length. In an initial stage of manufacture, gross thickness features may be machined 202 to provide the smooth transition. Specifically, FIG. 8 shows a machining from a pressure side face 120 to define the tapering region 106 and the straight region 108. The tenon 90 (FIG. 9) is then formed by machining material 204 from both the pressure side face 120 and the suction side face 122. However, the steps 202 and 204 may easily be combined or further divided.

Figure 10:
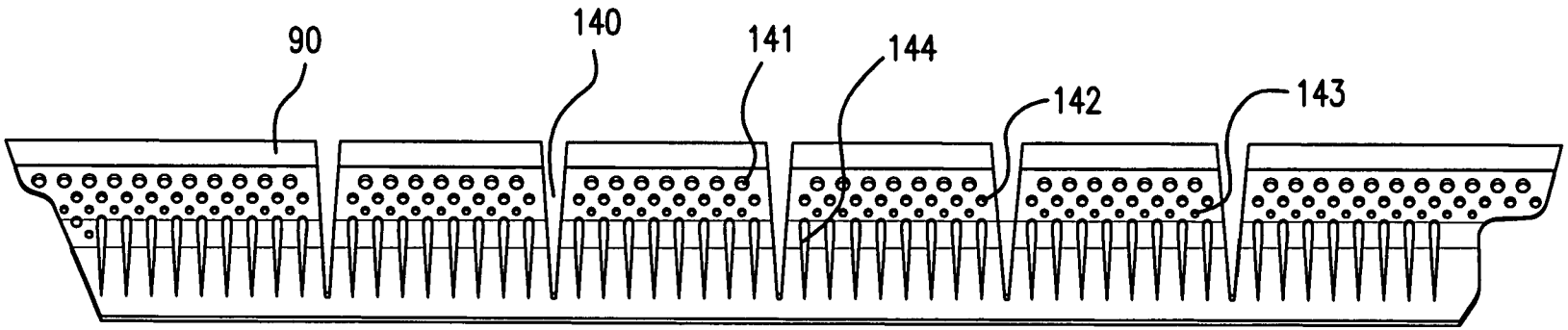
FIG. 10 is a first face plan view of the precursor of FIG. 9 after a through-cutting.
Figure 11:
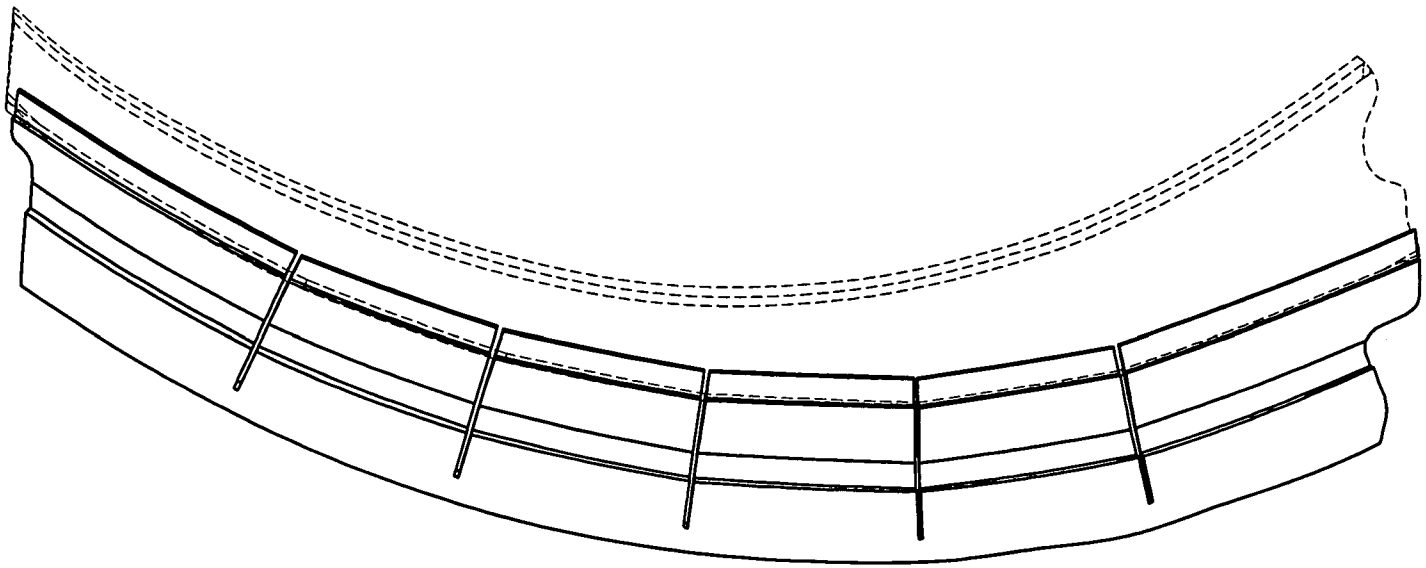
FIG. 11 is a simplified view of a core formed by bending the precursor of FIG. 10 at a plurality of recesses.

Additionally, a series of through-cuts are cut 206. A first group of through-cuts includes recesses 140 (FIG. 10) extending downstream through the tenon 90 and well into the trailing portion 110. Others of the cuts define apertures 141, 142, and 143 for forming posts 150, 152, and 153 (FIG. 2) within the outlet slot and apertures 144 for forming trailing dividing walls 154 along the slot outlet. To provide the RMC in the desired arcuate shape corresponding to the airfoil trailing edge, the RMC is bent 208 to partially close the recesses 140 (FIG. 11). The RMC may be coated 210 with a protective coating. Alternatively a coating could be applied pre-assembly. Suitable coating materials include silica, alumina, zirconia, chromia, mullite and hafnia. Preferably, the coefficient of thermal expansion (CTE) of the refractory metal and the coating are similar. Coatings may be applied by any appropriate line-of sight or non-line-of sight technique (e.g., chemical or physical vapor deposition (CVD, PVD) methods, plasma spray methods, electrophoresis, and sol gel methods). Individual layers may typically be 0.1 to 1 mil thick. Layers of Pt, other noble metals, Cr, Si, W, and/or Al, or other non-metallic materials may be applied to the metallic core elements for oxidation protection in combination with a ceramic coating for protection from molten metal erosion and dissolution.

The RMC may be assembled in a die and the ceramic core (e.g., silica-, zircon-, or alumina-based) molded thereover. An exemplary overmolding 212 includes molding the ceramic core 82 over the tenon 90. The as-molded ceramic material may include a binder. The binder may function to maintain integrity of the molded ceramic material in an unfired green state. Exemplary binders are wax-based. After the overmolding 212, the preliminary core assembly may be debindered/fired 214 to harden the ceramic (e.g., by heating in an inert atmosphere or vacuum).

Figure 12:
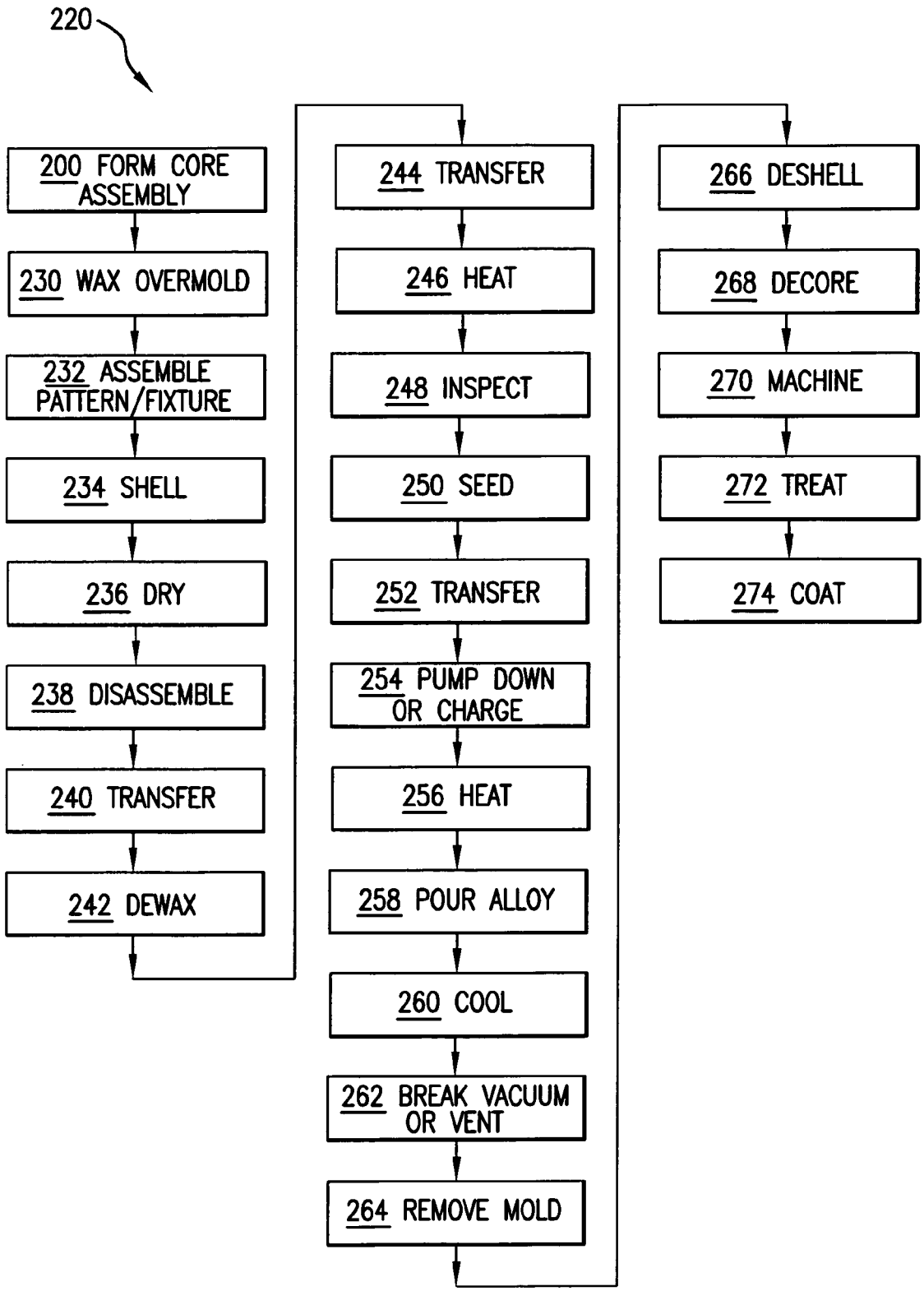
FIG. 12 is a flowchart of an investment casting method.

FIG. 12 shows an exemplary method 220 for investment casting using the core assembly. Other methods are possible, including a variety of prior art methods and yet-developed methods. The fired core assembly is then overmolded 230 with an easily sacrificed material such as a natural or synthetic wax (e.g., via placing the assembly in a mold and molding the wax around it). There may be multiple such assemblies involved in a given mold.

The overmolded core assembly (or group of assemblies) forms a casting pattern with an exterior shape largely corresponding to the exterior shape of the part to be cast. The pattern may then be assembled 232 to a shelling fixture (e.g., via wax welding between end plates of the fixture). The pattern may then be shelled 234 (e.g., via one or more stages of slurry dipping, slurry spraying, or the like). After the shell is built up, it may be dried 236. The drying provides the shell with at least sufficient strength or other physical integrity properties to permit subsequent processing. For example, the shell containing the invested core assembly may be disassembled 238 fully or partially from the shelling fixture and then transferred 240 to a dewaxer (e.g., a steam autoclave). In the dewaxer, a steam dewax process 242 removes a major portion of the wax leaving the core assembly secured within the shell. The shell and core assembly will largely form the ultimate mold. However, the dewax process typically leaves a wax or byproduct hydrocarbon residue on the shell interior and core assembly.

After the dewax, the shell is transferred 244 to a furnace (e.g., containing air or other oxidizing atmosphere) in which it is heated 246 to strengthen the shell and remove any remaining wax residue (e.g., by vaporization) and/or converting hydrocarbon residue to carbon. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation.

The mold may be removed from the atmospheric furnace, allowed to cool, and inspected 248. The mold may be seeded 250 by placing a metallic seed in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures. The mold may be transferred 252 to a casting furnace (e.g., placed atop a chill plate in the furnace). The casting furnace may be pumped down to vacuum 254 or charged with a non-oxidizing atmosphere (e.g., inert gas) to prevent oxidation of the casting alloy. The casting furnace is heated 256 to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured 258 into the mold and the mold is allowed to cool to solidify 260 the alloy (e.g., after withdrawal from the furnace hot zone). After solidification, the vacuum may be broken 262 and the chilled mold removed 264 from the casting furnace. The shell may be removed in a deshelling process 266 (e.g., mechanical breaking of the shell).

The core assembly is removed in a decoring process 268 to leave a cast article (e.g., a metallic precursor of the ultimate part). The cast article may be machined 270, chemically and/or thermally treated 272 and coated 274 to form the ultimate part. Some or all of any machining or chemical or thermal treatment may be performed before the decoring.

Figure 13:
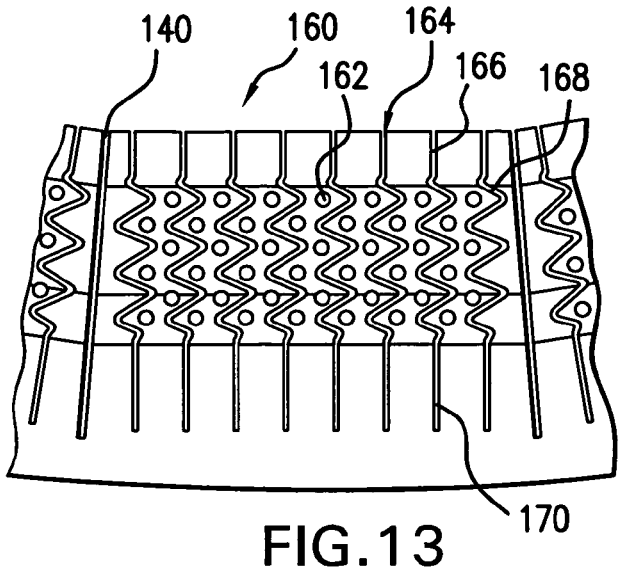
FIG. 13 is a partial first face view of a first alternate core.

FIG. 13 shows an RMC 160 otherwise similar to the RMC 84 but wherein the apertures 141, 142, 143 and 144 are replaced by combinations of apertures 162 and wave-like slots 164. Each of the exemplary slots 164 includes a straight leading portion 166 through the flange, a wave-like (e.g., sinusoidal) portion 168 in the RMC tapering portion and straight region, and a terminal straight portion 170 within the thicker portion. The apertures 162 are interspersed between the slots 164 in phase with the waveform. In the ultimate cast airfoil, adjacent slots 164 may form dividing walls (with passageways in between including posts cast by the apertures 162).

Figure 14:
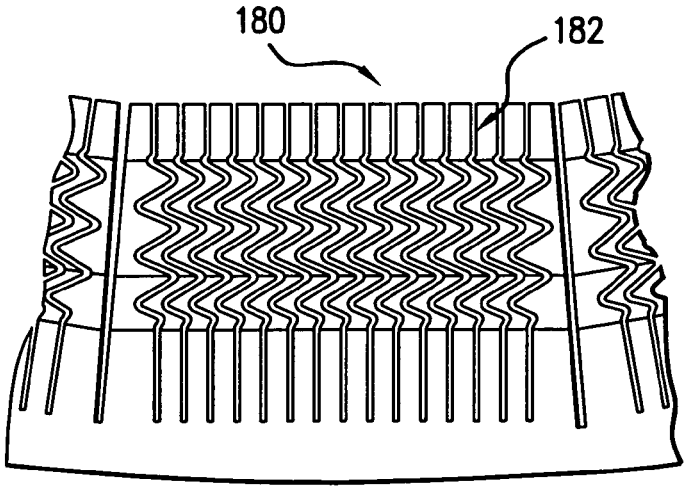
FIG. 14 is a partial first face view of a second alternate core.
Figure 15:
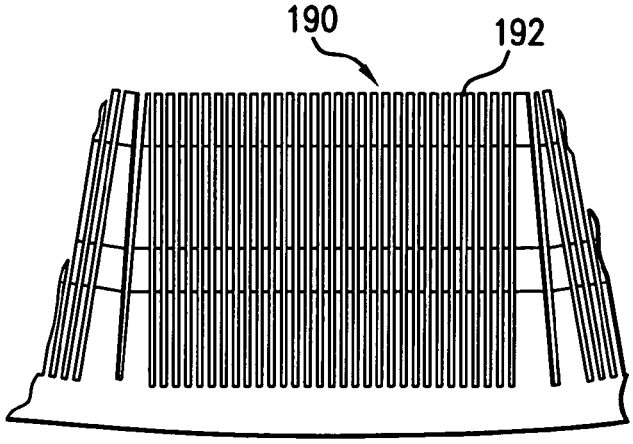
FIG. 15 is a partial first face view of a third alternate core.

FIG. 14 shows an RMC 180 with similar wave-like slots 182 but lacking the apertures 162. Accordingly, the slots may be at a closer spacing than the slots 164. FIG. 15 shows an RMC 190 with an array of straight slots 192 in view of the wave-like slots 182.

Figure 16:
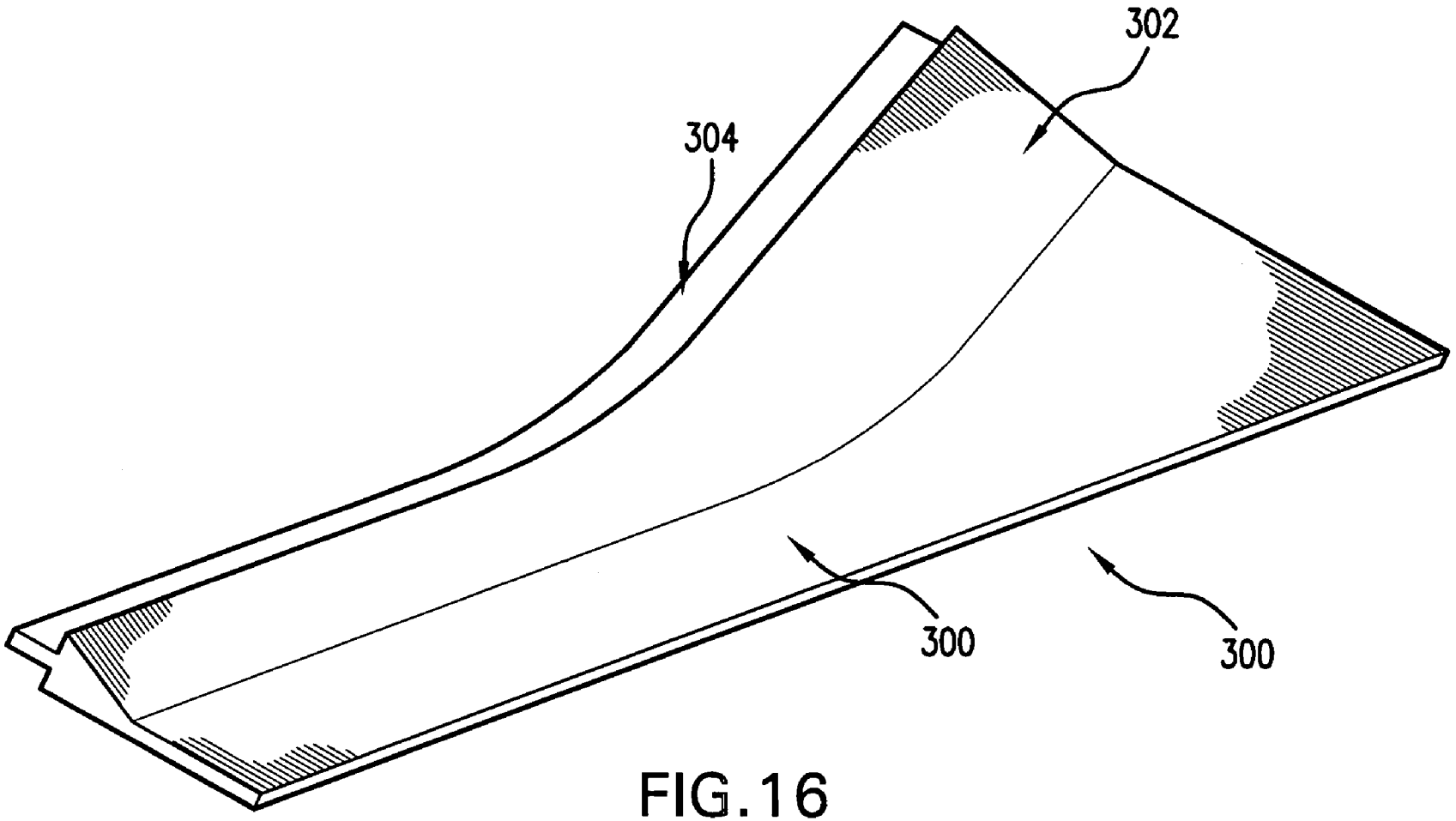
FIG. 16 is a view of a fourth alternate core.

FIG. 16 shows an RMC 300 having a spanwise variation in the angle of convergence of its tapering portion 302. The RMC's tenon 304 and the tapering portion 302 also have as-machined spanwise curvature (e.g., as distinguished from bending at recesses). A trailing portion 306 is also thin and flat (as distinguished from the portion 110 of FIG. 4 and, effectively a continuation of the portion 108). For ease of illustration, apertures are not shown.

Figure 17:
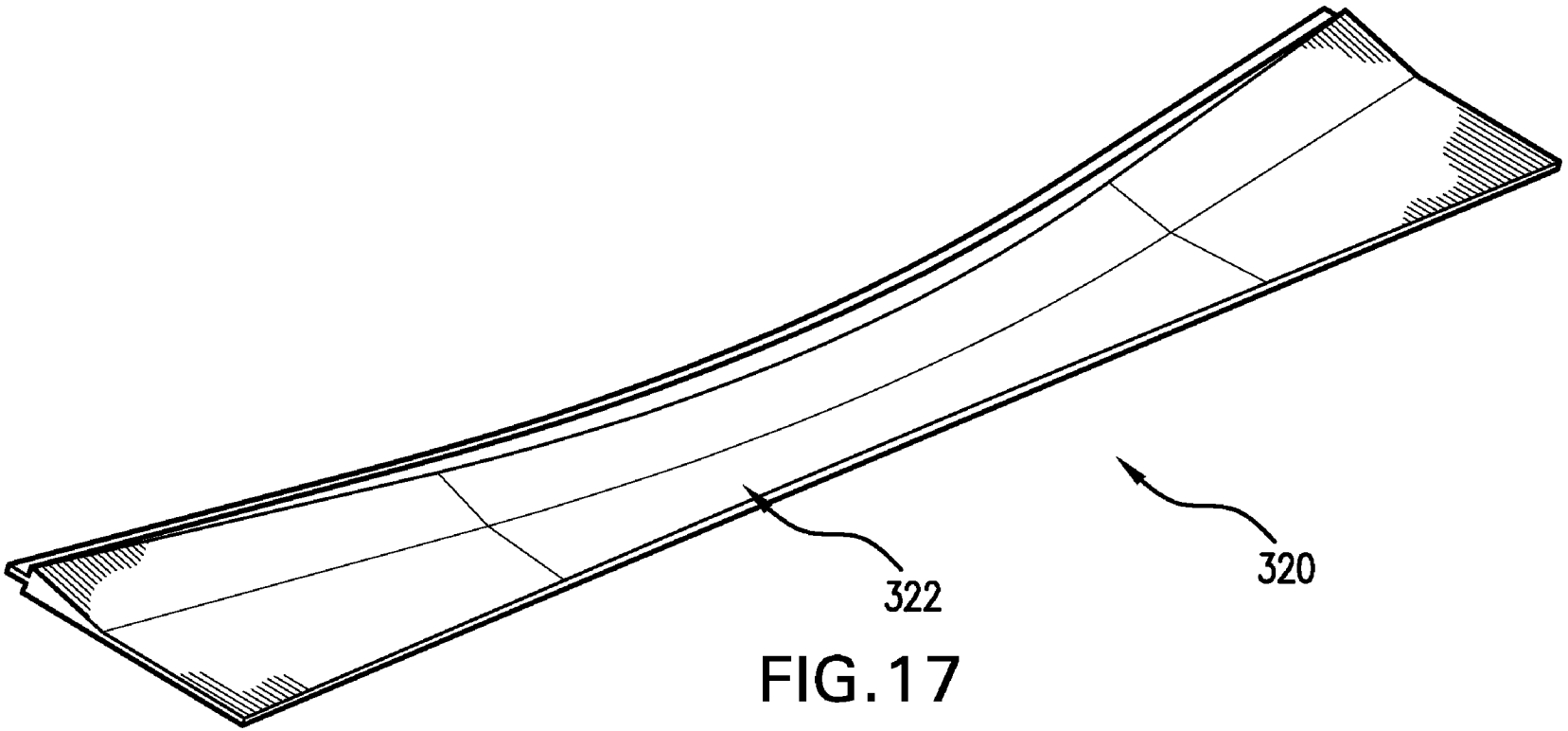
FIG. 17 is a view of a fifth alternate core.

FIG. 17 an RMC 320 also having spanwise curvature, but wherein the trailing portion 322 has a spanwise variation in thickness (e.g., thicker midspan and tapering toward the inboard and outboard ends). For ease of illustration, apertures are not shown.

Figure 18:
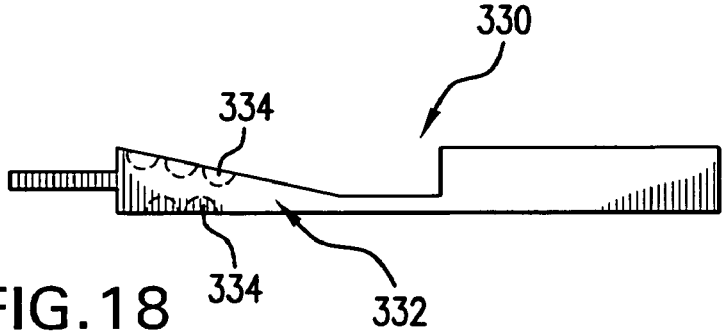
FIG. 18 is an end view of a sixth alternate core.

FIG. 18 shows an RMC 330 otherwise similar to the RMC 84 but wherein the tapering portion 332 has arrays of dimple-like blind recesses 334 along the pressure and suction side faces. The recesses may be chemically etched, mechanically drilled, laser drilled, or the like.

Figure 19:
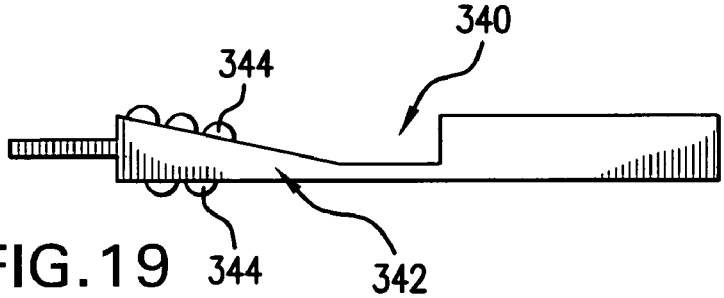
FIG. 19 is an end view of a seventh alternate core.

FIG. 19 shows an RMC 340 otherwise similar to the RMC 84 but wherein the tapering portion 342 has arrays of protrusions 344 along the pressure and suction side faces. The protrusions may be formed by welding or cladding or may be left after an etching, mechanical machining, laser drilling, EDM, or the like.

Figure 20:
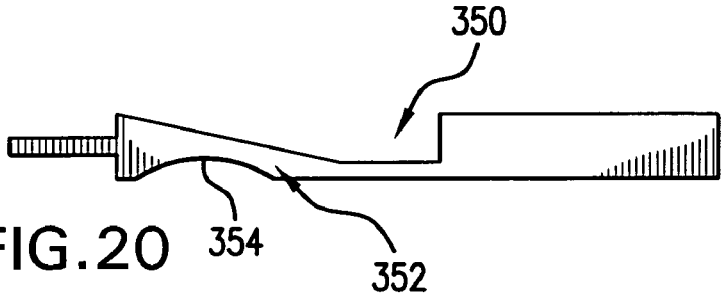
FIG. 20 is an end view of an eighth alternate core.

FIG. 20 shows an RMC 350 otherwise similar to the RMC 84 but wherein the tapering portion 352 has a streamwise concavity extending 354 along the suction side face. The concavity may be formed in the initial machining.

Figure 21:
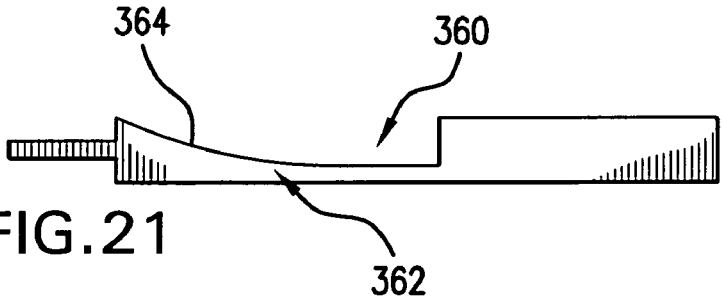
FIG. 21 is an end view of a ninth alternate core.
Figure 22:
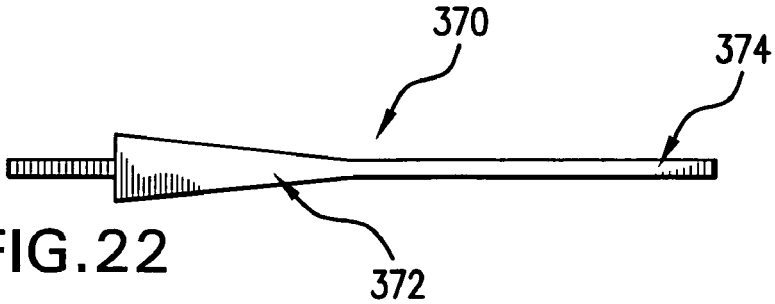
FIG. 22 is an end view of a tenth alternate core.

FIG. 21 shows an RMC 360 otherwise similar to the RMC 84 but wherein the tapering portion 362 has a streamwise concavity extending 364 along the pressure side face. The concavity may be formed in the initial machining FIG. 22 shows an RMC 370 otherwise similar to the RMC 84 but wherein the tapering portion 372 tapers along both the pressure and suction side faces. Also, the exemplary RMC 370 has a thin trailing portion 374 in place of the thick trailing portion 110.

One or more embodiments of the present invention have been described. Nevertheless, it will be understood that various modifications may be made without departing from the spirit and scope of the invention. For example, the principles may be implemented using modifications of various existing or yet-developed processes, apparatus, or resulting cast article structures (e.g., in a reengineering of a baseline cast article to modify cooling passageway configuration). In any such implementation, details of the baseline process, apparatus, or article may influence details of the particular implementation. Accordingly, other embodiments are within the scope of the following claims.

What is claimed is:

1. A method for manufacturing an investment casting core from a metallic blank having a thickness between parallel first and second faces less than a width and length transverse thereto, the method comprising:

locally thinning the blank from at least one of the first and second faces, the locally thinning comprising forming a mounting flange by thinning from both the first and second faces;

through-cutting the blank across the thickness forming a plurality of through-apertures and a plurality of recesses, at least one of the recesses having an opening on the flange side;

after the through-cutting, bending the blank to at least partially contract the at least one of the recesses having an opening on the flange side; and at least one of:

molding a ceramic core over the mounting flange; and inserting the mounting flange into a mating slot of a pre-molded ceramic core.

2. The method of claim 1 wherein:

at least the through-cutting comprises at least one of stamping, laser cutting, liquid jet cutting, and EDM.

3. The method of claim 1 wherein:

at least the locally thinning comprises at least one of stamping, EDM, ECM, grinding, and mechanical machining.

4. The method of claim 1 wherein:

the through-cutting and the locally thinning are performed separately.

5. The method of claim 1 wherein:

the through-cutting and the locally thinning are performed in a single step.

6. The method of claim 1 wherein:

the locally thinning comprises machining a downstream-tapering portion downstream of the flange and leaving a thicker portion downstream of the downstream-tapering portion.

7. The method of claim 1 further comprising:

coating the core.

8. The method of claim 1 wherein:

the through-cutting forms apertures within the blank.

9. A method for investment casting comprising:

forming according to claim 1 an investment casting core;

molding a pattern-forming material at least partially over the at least one investment casting core for forming a pattern;

shelling the pattern;

removing the pattern-forming material from the shelled pattern for forming a shell;

introducing molten alloy to the shell; and removing the shell.

10. The method of claim 9 used to form a gas turbine engine airfoil wherein the core forms trailing edge outlet passageways.

11. The method of claim 10 wherein:

the mounting flange extends from a second portion and the ceramic core has slot shoulders abutting shoulders of the second portion.

12. The method of claim 11 wherein:

a smooth continuous taper spans a junction between the core and the ceramic core.

13. The method of claim 12 wherein:

a relatively thicker portion is downstream of the taper and a constant thickness portion is between the taper and the relatively thicker portion.

14. The method of claim 13 wherein the relatively thicker portion protrudes along a pressure side but not along a suction side.

15. A method for manufacturing an investment casting core used to form a gas turbine engine airfoil trailing edge outlet passageways, the method forming the core from a metallic blank having a thickness between parallel first and second faces less than a width and length transverse thereto, the method comprising:

locally thinning the blank from at least one of the first and second faces, the locally thinning forming a flange along the edge of the core; and through-cutting the blank across the thickness, the through-cutting comprising forming a plurality of through-apertures and a plurality of recesses, the through-cutting forming said recesses along the flange; and after the through cutting, bending the blank to at least partially contract the recesses, the recesses opening to an edge of the core and the bending contracting the recesses to conform the core to an arcuate shape of the airfoil trailing edge.

16. A method for investment casting comprising:

forming according to claim 15 an investment casting core;

molding a pattern-forming material at least partially over the at least one investment casting core for forming a pattern;

shelling the pattern;

removing the pattern-forming material from the shelled pattern for forming a shell;

introducing molten alloy to the shell; and removing the shell.

17. The method of claim 16 wherein said forming further comprises at least one of:

overmolding a ceramic core to a thinned portion of the core; and inserting a thinned portion of the core into a slot in a pre-molded ceramic core.

* * * * *